US009205666B2

(12) United States Patent
Yoshii et al.

(10) Patent No.: US 9,205,666 B2
(45) Date of Patent: Dec. 8, 2015

(54) LIQUID CONTAINER AND RECORDING DEVICE ON WHICH LIQUID CONTAINER IS MOUNTED

(71) Applicant: CANON KABUSHIKI KAISHA, Tokyo (JP)

(72) Inventors: Kazuya Yoshii, Yokohama (JP); Yasuo Kotaki, Yokohama (JP); Kenta Udagawa, Tokyo (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/707,973

(22) Filed: May 8, 2015

(65) Prior Publication Data

US 2015/0321483 A1 Nov. 12, 2015

(30) Foreign Application Priority Data

May 12, 2014 (JP) ..... 2014-099080

(51) Int. Cl.
*B41J 2/175* (2006.01)
*B41J 2/19* (2006.01)

(52) U.S. Cl.
CPC . *B41J 2/19* (2013.01); *B41J 2/1752* (2013.01)

(58) Field of Classification Search
CPC ..... B41J 2/19; B41J 2/1752; B41J 2/17523; B41J 2/17553; B41J 2/17503
See application file for complete search history.

(56) References Cited

U.S. PATENT DOCUMENTS 7,954,933 B2 * 6/2011 Fung et al. ..... 347/86

FOREIGN PATENT DOCUMENTS

JP 2005-007855 A 1/2005

* cited by examiner

*Primary Examiner* — Juanita D Jackson
(74) *Attorney, Agent, or Firm* — Canon USA Inc. IP Division

(57) ABSTRACT

In a state in which a liquid container is mounted on a recording device, a liquid ejection head communicates with a liquid chamber through a first liquid channel and a second liquid channel, an opening of the first liquid channel at a side far from the liquid ejection head and an opening of the second liquid channel at a side far from the liquid ejection head are made at the liquid chamber, the opening of the first liquid channel is located at an upper side in a gravitational direction as compared with the opening of the second liquid channel, and an air-liquid interface in the first liquid channel is held by a meniscus force so that the air-liquid interface in the first liquid channel is located at the upper side in the gravitational direction as compared with an air-liquid interface in the second liquid channel.

19 Claims, 7 Drawing Sheets

LIQUID CONTAINER AND RECORDING DEVICE ON WHICH LIQUID CONTAINER IS MOUNTED

BACKGROUND OF THE INVENTION

1. Field of the Invention

The present invention relates to a liquid container and a recording device on which the liquid container is mounted.

2. Description of the Related Art

A liquid container such as an ink cartridge is mounted on a recording device such as an ink jet printer. Liquid is supplied from the mounted liquid container to a liquid ejection head included in the recording device. Such a recording device ejects the liquid from the liquid ejection head onto a recording medium, and hence performs recording of characters, images, etc.

The liquid (ink) stored in a liquid chamber of the liquid container is required to have a constant density in the liquid chamber; however, density unevenness of the liquid may occur. Particularly in case of liquid containing a pigment, the pigment may be likely precipitated. When the pigment is precipitated, a phenomenon occurs in which the density of the pigment is high at the lower (bottom surface) side and is low at the upper (upper surface) side in the liquid chamber. Herein, a case is considered in which, in a configuration of leading out the liquid from the bottom surface side of the liquid container, the liquid container is kept in a constant posture (in a state in which the bottom surface faces the lower side in the gravitational direction) for a long period. When the liquid is supplied from such a liquid container to a recording head, the liquid forming a layer with a high density of pigment particles is supplied first, and hence an image of a color with a high density is recorded. Also, a difference in recording density may appear between a recorded image in an early phase of use and a recorded image in a later phase of use of the liquid container. Such a phenomenon tends to be particularly noticeable in case of color recording that records a color image by using gradations of colors.

To address such a problem, Japanese Patent Laid-Open No. 2005-7855 describes provision of a pipe extending from a liquid lead-out portion provided at the bottom surface side of a liquid chamber to the upper side in the gravitational direction of the liquid chamber. The pipe has a plurality of liquid inlet ports communicating with the inside of the liquid chamber respectively at a plurality of positions in the gravitational direction. Among these liquid inlet ports, the liquid inlet port located at the lower side in the gravitational direction is configured to have a high inflow resistance as compared with those of the other liquid inlet ports. With this configuration, the liquid can be taken by amounts corresponding to the inflow resistances respectively from a portion with a high density of pigment particles and a portion with a low density of pigment particles in the liquid chamber, and the blended liquid can be led out from the liquid container.

SUMMARY OF THE INVENTION

The above-described problem is addressed by aspects of the invention. In particular, according to an aspect of the invention, there is provided a recording device including a liquid ejection head, a liquid container configured to be mounted on the recording device and having a liquid chamber configured to store liquid. In a state in which the liquid container is mounted on the recording device, the liquid ejection head communicates with the liquid chamber through a first liquid channel and a second liquid channel, an opening of the first liquid channel at a side far from the liquid ejection head and an opening of the second liquid channel at a side far from the liquid ejection head are made at the liquid chamber, the opening of the first liquid channel at the side far from the liquid ejection head is located at an upper side in a gravitational direction as compared with the opening of the second liquid channel at the side far from the liquid ejection head, and an air-liquid interface in the first liquid channel is held by a meniscus force so that the air-liquid interface in the first liquid channel is located at the upper side in the gravitational direction as compared with an air-liquid interface in the second liquid channel.

According to another aspect of the invention, there is provided a liquid container configured to be mounted on a recording device including a liquid ejection head, and having a liquid chamber configured to store liquid. A first liquid channel and a second liquid channel that supply the liquid to the liquid ejection head are formed in the liquid chamber. In a mounted state on the recording device, the liquid ejection head communicates with the liquid chamber through the first liquid channel and the second liquid channel, an opening of the first liquid channel at a side far from the liquid ejection head and an opening of the second liquid channel at a side far from the liquid ejection head are made at the liquid chamber, the opening of the first liquid channel at the side far from the liquid ejection head is located at an upper side in a gravitational direction as compared with the opening of the second liquid channel at the side far from the liquid ejection head, and an air-liquid interface in the first liquid channel is held by a meniscus force so that the air-liquid interface in the first liquid channel is located at the upper side in the gravitational direction as compared with an air-liquid interface in the second liquid channel.

Further features of the present invention will become apparent from the following description of exemplary embodiments with reference to the attached drawings.

DESCRIPTION OF THE EMBODIMENTS

When the air is introduced into a liquid chamber as liquid is consumed, the air-liquid interface is lowered as the air is introduced. In the configuration in Japanese Patent Laid-Open No. 2005-7855, among the liquid inlet ports provided at the pipe extending toward the upper side in the gravitational direction, the liquid inlet ports start to communicate with the air above the air-liquid interface sequentially from the liquid inlet port provided at the upper side in the gravitational direction. Hence, as compared with the inflow resistance with which the liquid flows into the pipe through the liquid inlet port located at the lower side in the gravitational direction, the inflow resistance with which the air is led out from the liquid chamber through the pipe from the other liquid inlet port communicating with the air may be lower depending on the liquid lead-out speed. In this case, although the liquid remains at the height of the liquid inlet port located at the lower side in the gravitational direction of the liquid chamber and communication with the liquid is attained at this portion, the air may be led out from the liquid chamber. Consequently, the air flows into the liquid ejection head, and it may be difficult to provide proper ejection. Also, since the air led out from the liquid chamber of the liquid container flows to the liquid ejection head, even if the liquid remains in the liquid chamber, it may be determined that no liquid remains.

Accordingly, the present invention provides a configuration in which a liquid ejection head communicates with a liquid chamber of a liquid container through a plurality of liquid channels, and the configuration properly supplies the liquid ejection head with liquid in the liquid chamber even when the positions of openings of the plurality of liquid chambers made at the liquid chamber are different in the gravitational direction.

The invention is described below in detail with reference to the drawings.

Figure 1A:
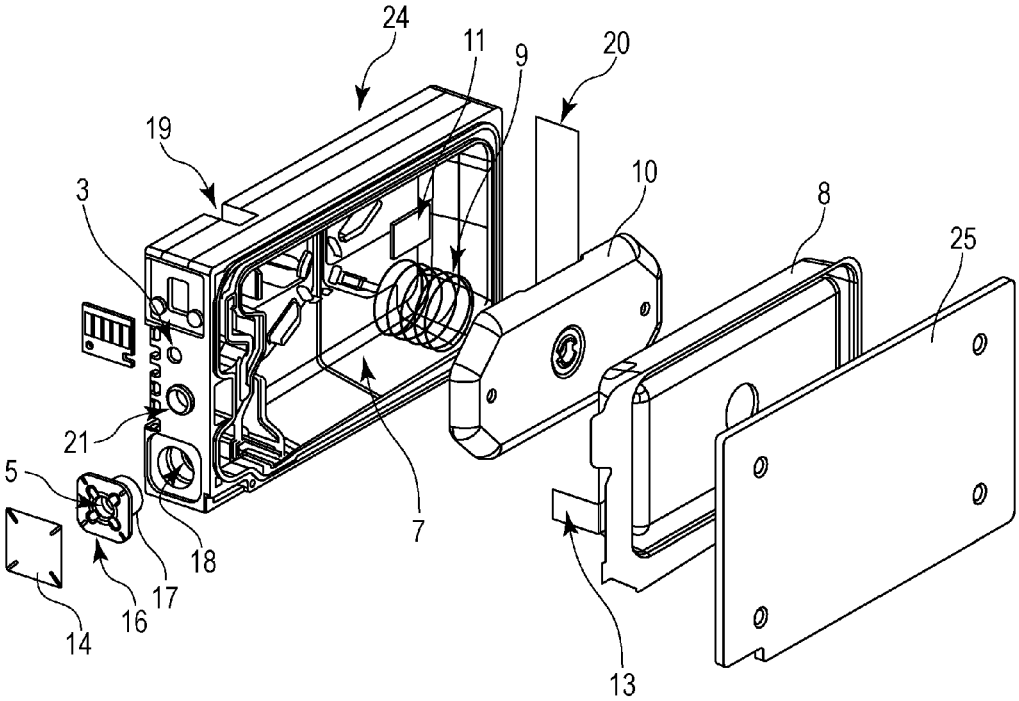
FIGS. 1A and 1B are an exploded view and a cross-sectional view of a liquid container.
Figure 1B:
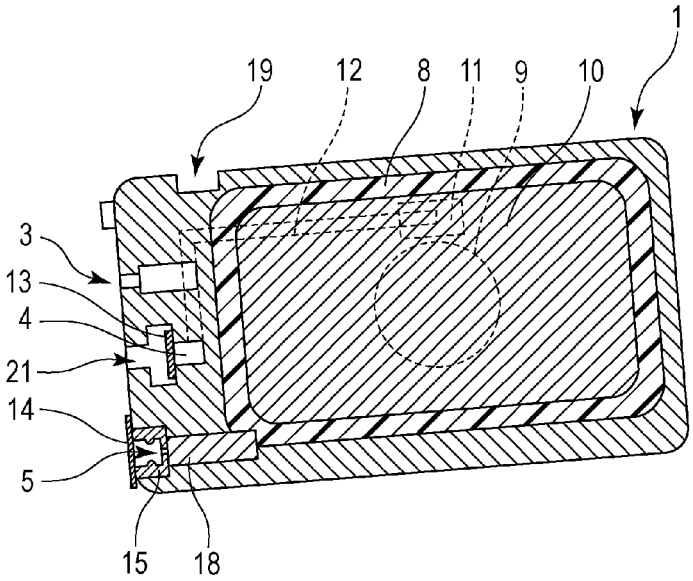
Figure 2A:
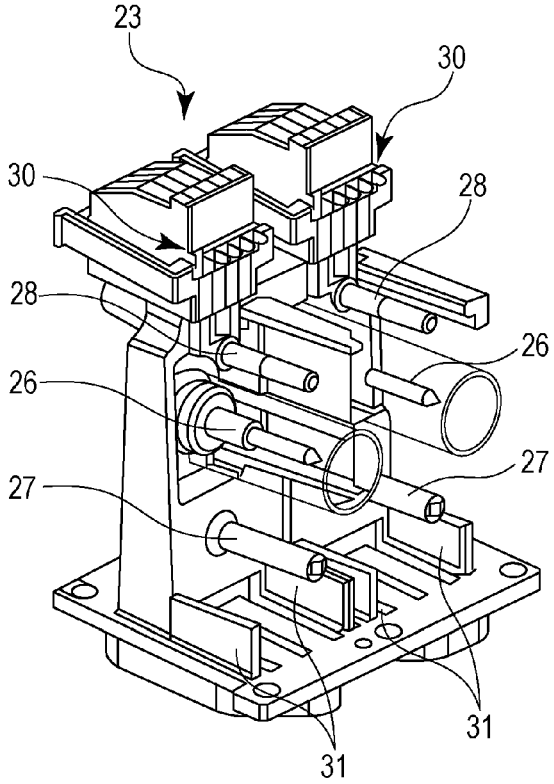
FIGS. 2A and 2B illustrate a recording device and the liquid container.
Figure 2B:
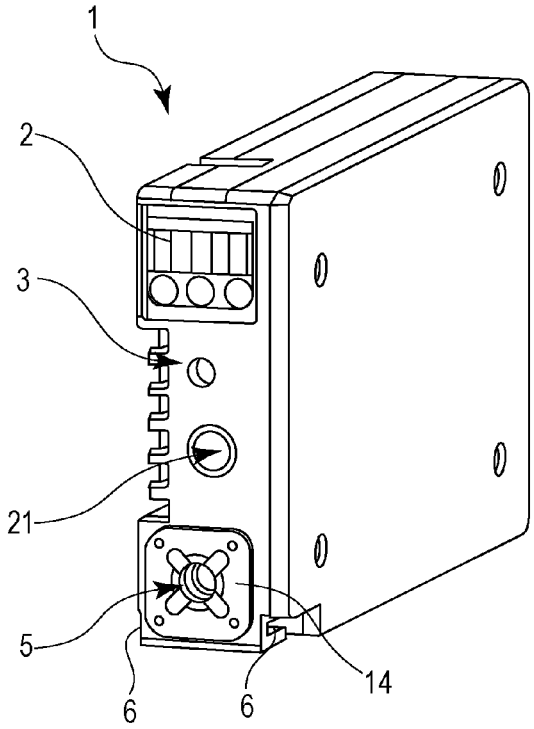

An inner configuration of a liquid container 1 is described with reference to FIGS. 1A and 1B. FIG. 1A is an exploded view in which the liquid container 1 is exploded. FIG. 1B is a cross-sectional view of the liquid container 1. The housing of the liquid container 1 includes a first housing member 24 and a second housing member 25. The second housing member 25 functions as a lid member that closes the opening of the first housing member 24. The liquid container 1 stores liquid such as ink in a liquid chamber 7. The liquid chamber 7 is a chamber that is configured of the inner wall surface of the first housing member 24 and a flexible member 8 (soft sheet) being in close contact with the inner wall edge of the first housing member 24, and stores the liquid therein. A seal member unit 16 is a member that is fitted into a pipe insertion path 18 provided at the first housing member 24. The seal member unit 16 includes a cylindrical seal member 15 having an openable and closable slit at one end and an opening at the other end, and an outer casing 17 integrated with the outer peripheral surface of the seal member 15. When the seal member unit 16 is inserted into the pipe insertion path 18, the opening at the other end defines a pipe insertion port 5.

In the liquid chamber 7, a negative pressure generating spring 9 serving as a negative pressure generating member, and a plate member 10 being slightly smaller than the inner wall periphery of the first housing member 24 are arranged. One end of the negative pressure generating spring 9 is engaged with the inner wall of the first housing member 24, and the other end of the negative pressure generating spring 9 is engaged with the plate member 10. The negative pressure generating spring 9 maintains the inside of the liquid chamber 7 in a constant negative-pressure range, by urging the flexible member 8 through the plate member 10 in a direction in which the liquid chamber 7 is expanded. When the liquid in the liquid chamber 7 is decreased because the liquid is supplied to the liquid ejection head, the negative pressure in the liquid chamber 7 is expected to be increased; however, the negative pressure generating spring 9 is contracted, and hence the plate member 10 is moved in a direction in which the inner capacity of the liquid chamber 7 is decreased. Accordingly, an increase in negative pressure is restricted.

The space between the liquid chamber 7 and the second housing member 25 (liquid non-storage space) communicates with the outside of the liquid container 1 through a communication path (not shown) and an air opening (not shown) provided at the rear wall of the liquid container 1. To be specific, a continuous meandering groove (not shown) is provided at the rear wall of the liquid container 1. One end of the groove communicates with the liquid non-storage space and the other end of the groove communicates with the air opening. A label 20 is attached to cover the meandering groove, and the groove covered with the label 20 functions as a communication path that makes communication between the liquid non-storage space and the air opening. When the plate member 10 is to be moved in the direction in which the inner capacity of the liquid chamber 7 is decreased, the air is taken from the air opening to the space between the liquid chamber 7 and the second housing member 25 (the liquid non-storage space) through the communication path.

The liquid is supplied because the plate member 10 is moved. When the liquid is further consumed, the negative pressure in the liquid chamber 7 reaches the meniscus force or higher of a filter 11. Consequently, the air is introduced from an air communication path 12 into the liquid chamber 7 through the filter 11 as described above. Since the air is introduced from the air communication path 12 into the liquid chamber 7 by the amount by which the liquid is supplied, the negative pressure in the liquid chamber 7 is maintained in a constant negative-pressure range thereafter, and an excessive increase in negative pressure is restricted.

Figure 3A:
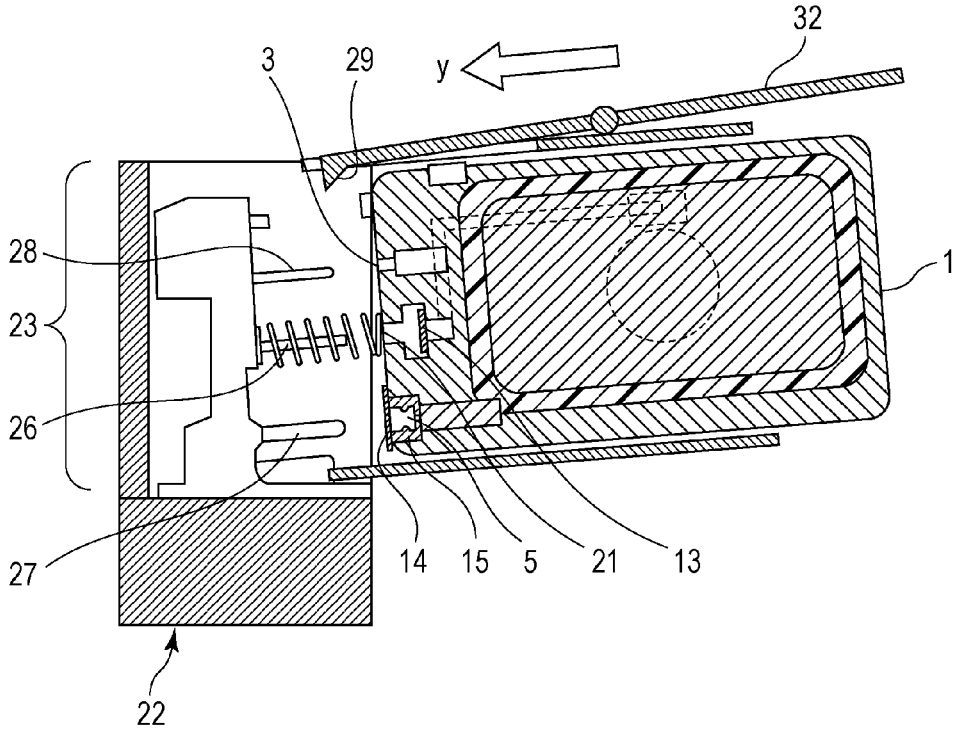
FIGS. 3A and 3B illustrate a mount process of the liquid container on the recording device.
Figure 3B:
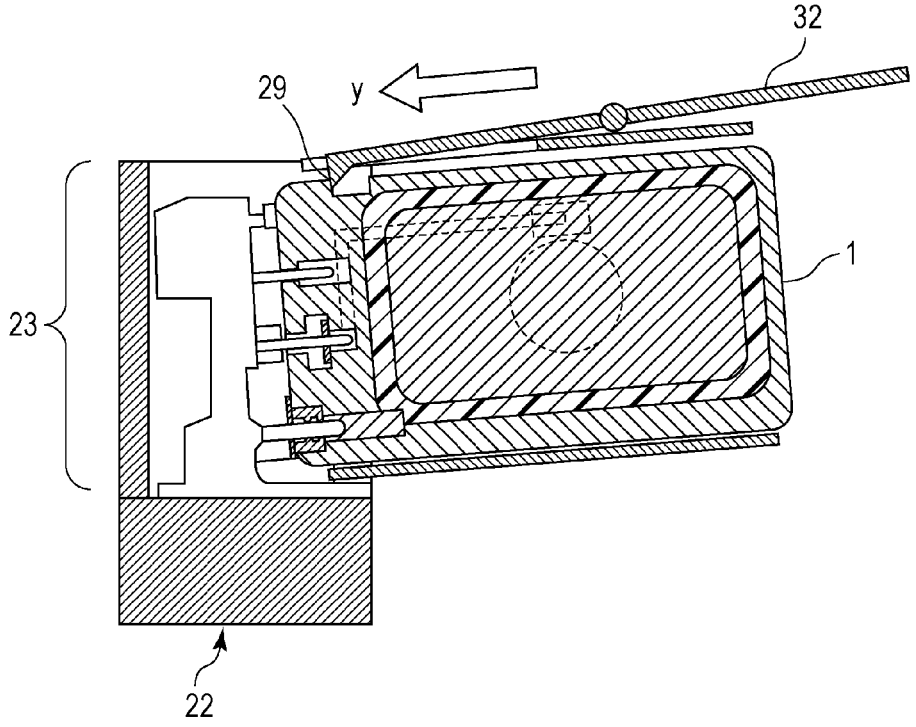

Next, a mount state of the liquid container 1 with respect to a mount portion 23 of a recording device is described with reference to FIGS. 2A to 3B. When the liquid container 1 is inserted into the mount portion 23 in a direction indicated by an arrow y, a pipe-insertion-port sealing film 14 is opened by a distal end of a liquid receiving pipe 27, and the liquid receiving pipe 27 is inserted into the pipe insertion port 5. Then, a positioning pin 28 is inserted into a positioning hole 3, and two position restricting surfaces 6 are sandwiched between two positioning walls 31. Accordingly, misalignment is restricted. Then, an air-communication-port sealing film 13 is opened by an opening pin 26 that is inserted into a through hole 21, and the opening pin 26 is inserted into an air communication port 4. Then, the liquid receiving pipe 27 is inserted into a slit of the seal member 15 provided in the pipe insertion path 18, and hence the liquid chamber 7 communicates with the liquid receiving pipe 27. Then, an electric contact 2 contacts an electric connection part 30. Finally, when the liquid container 1 is pushed to a position at which an engagement portion 19 is engaged with an engagement protrusion 29 of an engagement lever 32, the liquid container 1 is fixed and is in a mount completion state as shown in FIG. 3B. In this way, the state in which the liquid container is mounted on the recording device is provided.

The mount portion 23 is a part of the recording device. The recording device includes a liquid ejection head 22. Since the liquid chamber 7 communicates with the liquid receiving pipe 27 via the liquid, the liquid in the liquid chamber 7 is supplied to the liquid ejection head 22 through the liquid receiving pipe 27.

Next, a plurality of liquid channels are described. FIGS. 4A to 4D show that liquid 37 in the liquid chamber 7 which is the inside of the liquid container 1 is decreased as the liquid 37 is ejected from the liquid ejection head in the state in which the liquid container 1 is mounted on the recording device. The interface between the liquid 37 and the air 38 shown in FIGS. 4B to 4D is the air-liquid interface. In the liquid chamber 7 of the liquid container 1, a first liquid channel 34 and a second liquid channel 35 are formed.

Figure 4A:
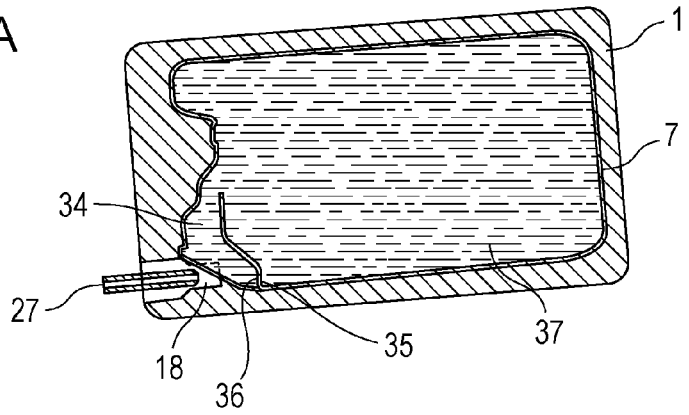
FIGS. 4A to 4D are cross-sectional views of the liquid container.
Figure 4B:
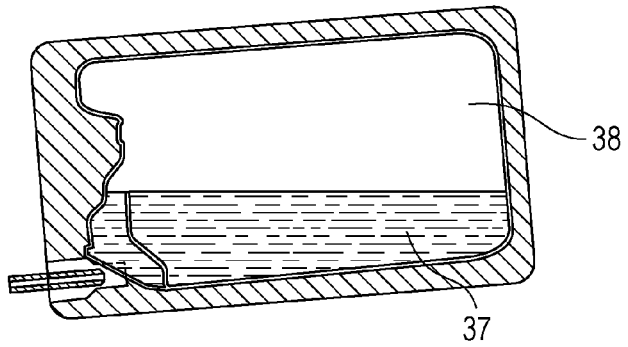
Figure 4C:
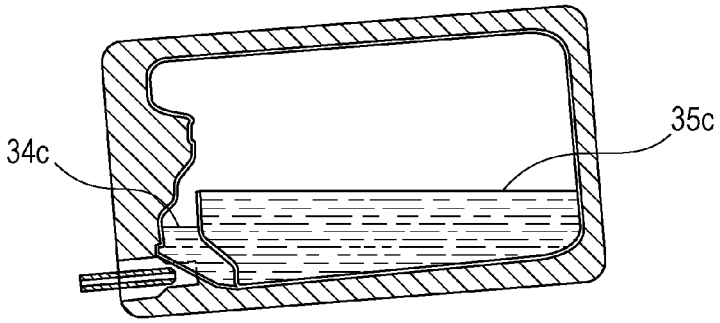
Figure 4D:
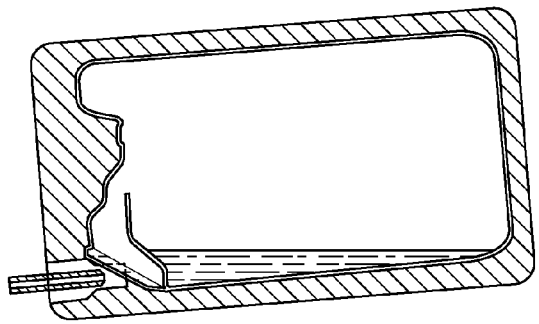

FIG. 4A shows a state immediately after the liquid container 1 is mounted on the mount portion 23 and the liquid receiving pipe 27 is connected to the pipe insertion path 18.

The liquid ejection head communicates with the liquid container through the first liquid channel 34 and the second liquid channel 35.

Figure 6A:
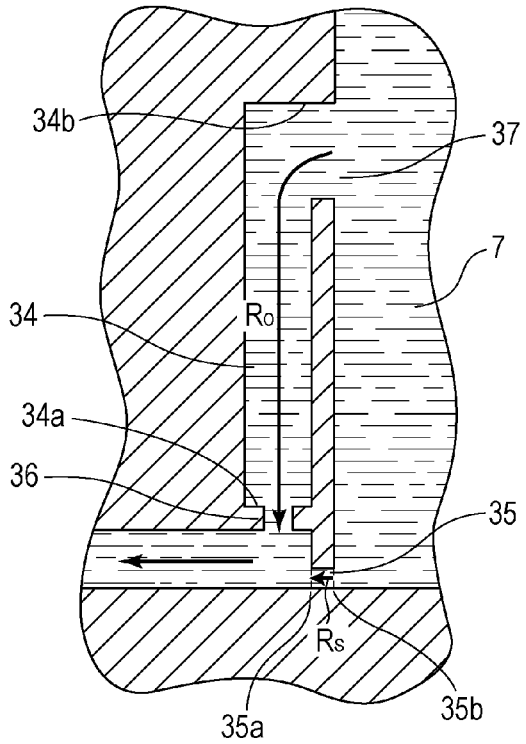
FIGS. 6A to 6C illustrate the liquid channels formed in the liquid container.
Figure 6B:
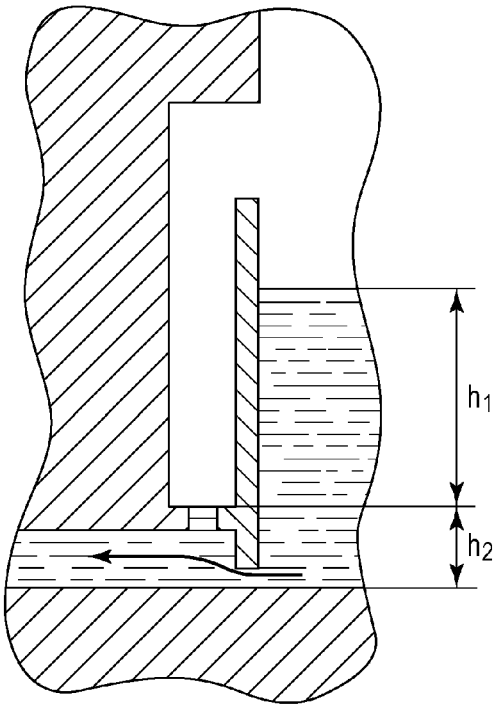
Figure 6C:
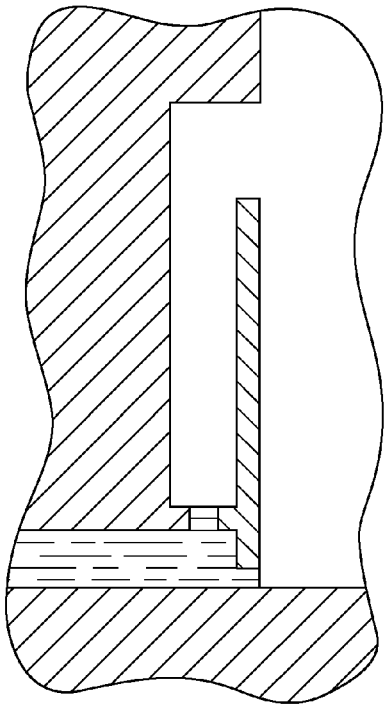

FIGS. 6A to 6C schematically show the first liquid channel 34 and the second liquid channel 35 in an enlarged manner. The first liquid channel 34 has an opening 34*a* at a side close to the liquid ejection head, and an opening 34*b* at a side far from the liquid ejection head. Also, the second liquid channel 35 has an opening 35*a* at a side close to the liquid ejection head, and an opening 35*b* at a side far from the liquid ejection head. In FIGS. 6A to 6C, the first liquid channel 34 and the second liquid channel 35 are formed in the liquid chamber 7. Hence, the opening 34*a* of the first liquid channel 34 at the side close to the liquid ejection head and the opening 34*b* of the first liquid channel 34 at the side far from the liquid ejection head are formed in the liquid chamber 7. Similarly, the opening 35*a* of the second liquid channel 35 at the side close to the liquid ejection head and the opening 35*b* of the second liquid channel 35 at the side far from the liquid ejection head are formed in the liquid chamber 7.

The opening 34*b* of the first liquid channel 34 at the side far from the liquid ejection head is located at an upper side in the gravitational direction as compared with the opening 35*b* of the second liquid channel 35 at the side far from the liquid ejection head. The first liquid channel 34 and the second liquid channel 35 meet each other at a downstream side in a liquid supply direction of the opening 34*a* and the opening 35*a*. The liquid is expected to be liquid containing a pigment (for example, pigment ink). Sections of the liquid 37 in the liquid chamber 7 with different densities of pigment particles are respectively led out from the first liquid channel 34 and the second liquid channel 35 to the pipe insertion path in accordance with a ratio inversely proportional to a ratio of an inflow resistance R, of the first liquid channel 34 to an inflow resistance R, of the second liquid channel 35. Then, the sections of the liquid 37 with the different densities of pigment particles are blended in a process until the liquid 37 is supplied to the liquid ejection portion from the pipe insertion path 18, and the liquid 37 in which the sections of the liquid of the different densities are blended with a certain constant ratio is supplied to the liquid ejection head. That is, since the opening 34*b* of the first liquid channel 34 and the opening 35*b* of the second liquid channel 35 have the above-described positional relationship, even when the pigment is precipitated in the liquid 37 in the liquid chamber 7, the liquid 37 with a density of pigment particles within a constant range can be supplied.

To use up the liquid in the liquid chamber 7, the opening 35*b* of the second liquid channel 35 may be desirably formed at a position close to the bottom surface, which is a surface of the liquid chamber at a lower side in the gravitational direction. That is, the opening 35*b* may be desirably formed to be adjacent to the bottom surface of the liquid chamber.

When the liquid 37 is consumed and the negative pressure in the liquid chamber 7 reaches the meniscus force or higher of the filter 11, the air at the air-communication-path side breaks the meniscus of the filter 11 and is introduced into the liquid chamber 7. Then, since the air is introduced into the liquid chamber 7 by the amount by which the liquid 37 is consumed, the interface (the air-liquid interface) between the liquid 37 and the air 38 in the liquid chamber 7 is gradually moved to the lower side in the gravitational direction as the liquid 37 is consumed. When the liquid is consumed from the state in FIG. 4A, the state becomes a state shown in FIG. 4B and then a state shown in FIG. 4C.

FIG. 4B shows a state in which the liquid 37 is consumed and the air-liquid interface in the liquid chamber 7 is located at the position of the opening 34*b* of the first liquid channel 34.

As shown in FIG. 6A, a protrusion may be formed at the opening 34*a* of the first liquid channel 34 so that the width of the first liquid channel 34 is decreased. If the protrusion is formed, this portion is called meniscus formation portion 36. Also, in this case, an example is shown in which the first liquid channel 34, the second liquid channel 35, and the meniscus formation portion 36 are formed by sealing a surface integrally formed with the first housing member 24 and having a substantially groove-shaped opening, by using the flexible member 8.

Figure 5:
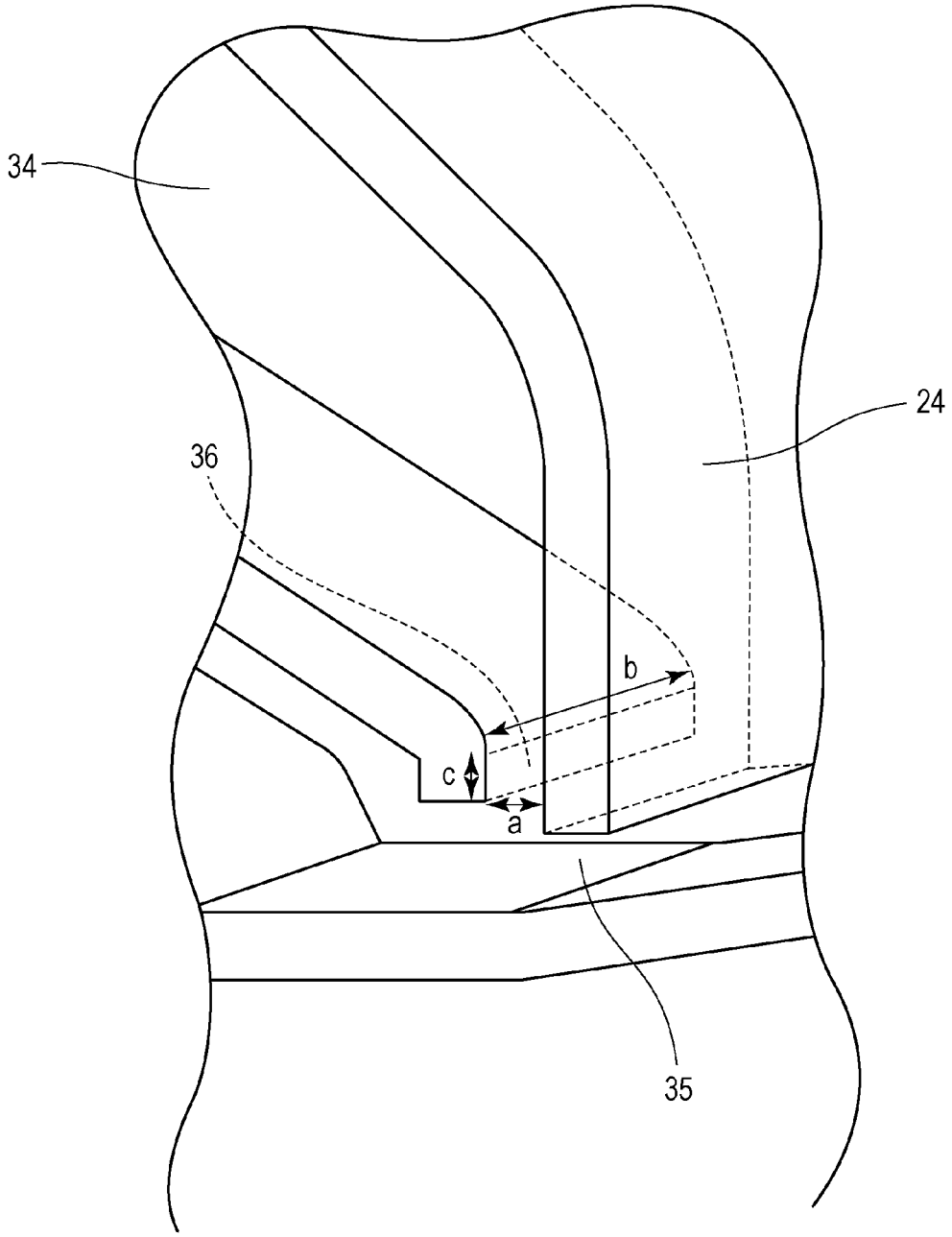
FIG. 5 illustrates liquid channels formed in the liquid container.

In the state in FIG. 4C, an air-liquid interface 34*c* of the first liquid channel 34 is located at the lower side in the gravitational direction as compared with an air-liquid interface 35*c* of the second liquid channel 35. As the liquid is used, the air-liquid interface 34*c* and the air-liquid interface 35*c* become a state in FIG. 4D while maintaining this positional relationship. In FIG. 4D, the air-liquid interface 34*c* reaches the opening 34*a*. An enlarged view of FIG. 4D is FIG. 6B. At this time, the air-liquid interface generates a certain constant meniscus force at the meniscus formation portion 36. The meniscus force of the liquid 37 formed at the meniscus formation portion 36 is determined by the width (a direction in FIG. 5A) of the groove of the first housing member 24 forming the meniscus formation portion 36, the surface tension of the liquid 37, and the contact angle between the liquid 37 and the first housing member 24. At this time, the meniscus formation portion 36 is configured to satisfy an expression as follows, when it is assumed that a portion, in which the air-liquid interface is formed in the first liquid channel 34, is the meniscus formation portion:

$$H \geq h_1 + h_2,$$

where $H = P_m/\rho g$, $h_1 = P_s/\rho g$, $h_2$ is a difference in height of the meniscus formation portion and a communication portion between the opening of the second liquid channel and the inside of the liquid chamber when the above-described liquid container is used, $P_m$ is a meniscus force that is generated at the meniscus formation portion, $\rho$ is a density of the liquid in the liquid chamber, g is a gravitational acceleration, and $P_s$ is a pressure loss of the second liquid channel with the maximum liquid flow rate when the above-described liquid container is used.

That is, the portion in which the air-liquid interface is formed in the first liquid channel held by the meniscus force may be desirably formed to satisfy the above-described expression.

In the state in which the first liquid channel 34 communicates with the liquid in the liquid chamber 7, the ratio of the amount of a liquid section with a high density of pigment particles led out through the second liquid channel 35, to the amount of a liquid section with a low density of pigment particles led out through the first liquid channel 34 is inversely proportional to the ratio of the inflow resistances of these channels. Also, the meniscus force of the meniscus formation portion 36 is determined by the width of the groove of the first housing member 24. Hence, by changing the depth of the groove (b direction in FIG. 5) and the length of the channel (c direction in FIG. 5) with respect to the width of the groove that can generate a predetermined meniscus force, the blend ratio of the liquid section with the high density of pigment particles to the liquid section with the low density of pigment particles can be changed in accordance with the difference in gradient of the densities of pigment particles of the liquid sections. For example, to increase the blend ratio of the liquid with the low density of pigment particles, the depth of the groove is increased. Also, the inflow resistance of the first liquid channel 34 can be decreased by arranging a plurality of meniscus formation portions 36 in parallel with respect to the flow of the liquid in the first liquid channel 34 when the liquid is supplied to the liquid ejection head.

In the above description, the liquid that is stored in the liquid chamber is the liquid containing the pigment; however, the liquid is not limited thereto. For example, liquid containing emulsion particles may have a problem of precipitation, and liquid containing a dye may have a problem of component unevenness in liquid.

In the above description, the example is provided in which the meniscus formation portion has the protrusion; however, the configuration is not limited thereto. For example, a filter may be formed in the first liquid channel, and the filter may serve as the meniscus formation portion. In this case, the air-liquid interface in the first liquid channel is held by the meniscus force at the portion of the filter. Alternatively, a form with a decreased width of the first liquid channel without formation of a protrusion may be employed. For example, an example shown in FIG. 5 may be conceived. In this case, in FIG. 5, the width in the a direction may be preferably in a range from 0.3 mm to 0.6 mm. Also, the width in the b direction is preferably in a range from 6.5 mm to 8.0 mm. Also, the width in the c direction may be preferably in a range from 0.4 mm to 0.9 mm.

In the state in which the liquid ejection head communicates with the liquid chamber through the second liquid channel via the liquid, in other words, in the state shown in each of FIGS. 4A to 4D, the air-liquid interface in the first liquid channel may be desirably held by the meniscus force. While the liquid ejection head communicates with the liquid chamber through the second liquid channel via the liquid, if the air-liquid interface in the first liquid channel is held by the meniscus force, the liquid can be used up properly.

Finally, the air is introduced from the opening 35*b* of the second liquid channel 35 at the side far from the liquid ejection head, to the opening 35*a* of the second liquid channel 35 at the side close to the liquid ejection head. Accordingly, the air may be desirably introduced from the opening 34*b* of the first liquid channel 34 at the side far from the liquid ejection head, to the opening 34*a* of the first liquid channel 34 at the side close to the liquid ejection head. When the air-liquid interface is held by the meniscus force at the opening 34*a*, if the air flows to the second liquid channel 35, the meniscus at the opening 34*a* is no longer maintained. Accordingly, the liquid can be used up properly.

The air-liquid interface in the first liquid channel 34 may be formed at any portion in the first liquid channel. However, the air-liquid interface may be desirably formed at the opening 34*a* of the first liquid channel 34 at the side close to the liquid ejection head as described above. If the air-liquid interface is formed at the opening 34*a*, the liquid can be used up properly.

Figure 7:
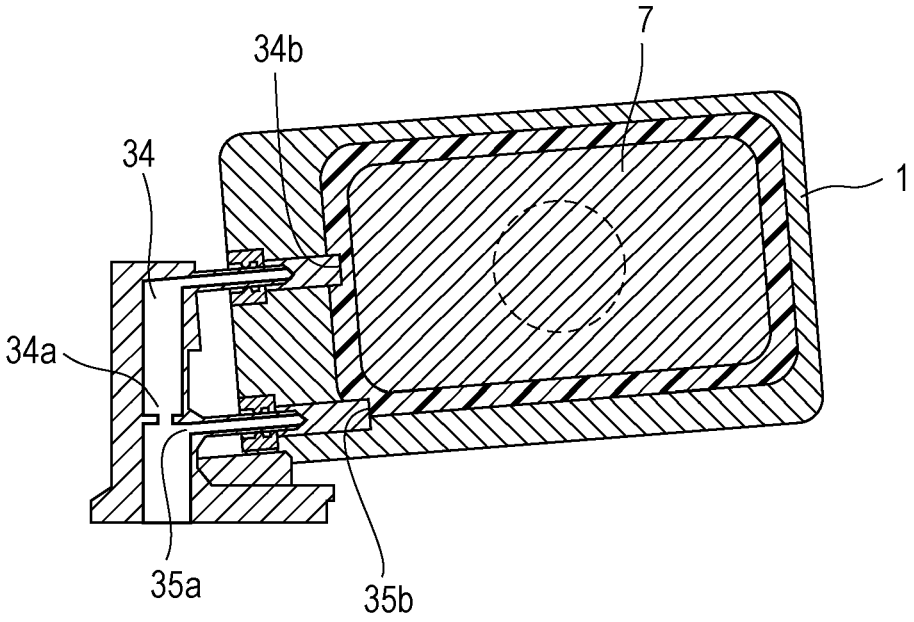
FIG. 7 illustrates liquid channels formed in the recording device.

The first liquid channel 34 and the second liquid channel 35 are configured to cause the liquid ejection head and the liquid chamber to communicate each other, and hence may be at least made at the liquid chamber 7. That is, the first liquid channel 34 or the second liquid channel 35 may not be formed in the liquid chamber 7. As shown in FIG. 7, the first liquid channel 34 and the second liquid channel 35 may be formed at the recording device side, for example, the mount portion 23 of the recording device. In this case, the opening 34*b* of the first liquid channel 34 at the side far from the liquid ejection head and the opening 35*b* of the second liquid channel 35 at the side far from the liquid ejection head are open at the liquid chamber 7.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-099080 filed May 12, 2014, which is hereby incorporated by reference herein in its entirety.

What is claimed is:

1. A recording device comprising:

a liquid ejection head; and a liquid container configured to be mounted on the recording device and having a liquid chamber configured to store liquid, wherein, in a state in which the liquid container is mounted on the recording device, the liquid ejection head communicates with the liquid chamber through a first liquid channel and a second liquid channel, wherein, an opening of the first liquid channel at a side far from the liquid ejection head and an opening of the second liquid channel at a side far from the liquid ejection head are made at the liquid chamber, wherein, the opening of the first liquid channel at the side far from the liquid ejection head is located at an upper side in a gravitational direction as compared with the opening of the second liquid channel at the side far from the liquid ejection head, and wherein, an air-liquid interface in the first liquid channel is held by a meniscus force so that the air-liquid interface in the first liquid channel is located at the upper side in the gravitational direction as compared with an air-liquid interface in the second liquid channel.

2. The recording device according to claim 1, wherein, in the state in which the liquid container is mounted on the recording device, the opening of the second liquid channel is adjacent to a bottom surface, which is a surface of the liquid chamber at a lower side in the gravitational direction.

3. The recording device according to claim 1, wherein, while the liquid ejection head communicates with the liquid chamber through the second liquid channel via the liquid, the air-liquid interface in the first liquid channel is held by the meniscus force.

4. The recording device according to claim 1, wherein the air-liquid interface in the first liquid channel held by the meniscus force is formed at an opening of the first liquid channel at a side close to the liquid ejection head.

5. The recording device according to claim 1, wherein the first liquid channel and the second liquid channel are formed in the liquid chamber.

6. The recording device according to claim 1, wherein the air is introduced from the opening of the second liquid channel at the side far from the liquid ejection head into an opening of the second liquid channel at a side close to the liquid ejection head, and hence the air is introduced to the liquid ejection head.

7. The recording device according to claim 1, wherein a protrusion is formed in the first liquid channel so that a width of the first liquid channel is decreased, and the air-liquid interface in the first liquid channel is held by the meniscus force at a portion of the protrusion.

8. The recording device according to claim 1, wherein a filter is formed in the first liquid channel, and the air-liquid interface in the first liquid channel is held by the meniscus force at a portion of the filter.

9. The recording device according to claim 1, wherein a meniscus formation portion that is a portion, in which the air-liquid interface is formed in the first liquid channel, is formed to satisfy an expression as follows:

$$H \geq h_1 + h_2,$$

where $H = P_m/\rho g$, $h_1 = P_s/\rho g$, $h_2$ is a difference in height of the meniscus formation portion and a communication portion between the opening of the second liquid channel and the inside of the liquid chamber when the liquid container is used, $P_m$ is a meniscus force that is generated at the meniscus formation portion, ρ is a density of the liquid in the liquid chamber, g is a gravitational acceleration, and $P_s$ is a pressure loss of the second liquid channel with a maximum liquid flow rate when the liquid container is used.

10. The recording device according to claim 1, wherein the liquid is liquid containing a pigment.

11. A liquid container configured to be mounted on a recording device comprising:

a liquid ejection head; and a liquid chamber configured to store liquid, wherein a first liquid channel and a second liquid channel that supply the liquid to the liquid ejection head are formed in the liquid chamber, wherein, in a mounted state on the recording device, the liquid ejection head communicates with the liquid chamber through the first liquid channel and the second liquid channel, wherein, an opening of the first liquid channel at a side far from the liquid ejection head and an opening of the second liquid channel at a side far from the liquid ejection head are made at the liquid chamber, wherein, the opening of the first liquid channel at the side far from the liquid ejection head is located at an upper side in a gravitational direction as compared with the opening of the second liquid channel at the side far from the liquid ejection head, and wherein an air-liquid interface in the first liquid channel is held by a meniscus force so that the air-liquid interface in the first liquid channel is located at the upper side in the gravitational direction as compared with an air-liquid interface in the second liquid channel.

12. The liquid container according to claim 11, wherein, in the mounted state on the recording device, the opening of the second liquid channel is adjacent to a bottom surface, which is a surface of the liquid chamber at a lower side in the gravitational direction.

13. The liquid container according to claim 11, wherein, while the liquid ejection head communicates with the liquid chamber through the second liquid channel via the liquid, the air-liquid interface in the first liquid channel is held by the meniscus force.

14. The liquid container according to claim 11, wherein the air-liquid interface in the first liquid channel held by the meniscus force is formed at an opening of the first liquid channel at a side close to the liquid ejection head.

15. The liquid container according to claim 11, wherein the air is introduced from the opening of the second liquid channel at the side far from the liquid ejection head into an opening of the second liquid channel at a side close to the liquid ejection head, and hence the air is introduced to the liquid ejection head.

16. The liquid container according to claim 11, wherein a protrusion is formed in the first liquid channel so that a width of the first liquid channel is decreased, and the air-liquid interface in the first liquid channel is held by the meniscus force at a portion of the protrusion.

17. The liquid container according to claim 11, wherein a filter is formed in the first liquid channel, and the air-liquid interface in the first liquid channel is held by the meniscus force at a portion of the filter.

18. The liquid container according to claim 11, wherein a meniscus formation portion that is a portion, in which the air-liquid interface is formed in the first liquid channel, is formed to satisfy an expression as follows:

$$H \geq h_1 + h_2,$$

where $H = P_m/\rho g$, $h_1 = P_s/\rho g$, $h_2$ is a difference in height of the meniscus formation portion and a communication portion between the opening of the second liquid channel and the inside of the liquid chamber when the liquid container is used, $P_m$ is a meniscus force that is generated at the meniscus formation portion, ρ is a density of the liquid in the liquid chamber, g is a gravitational acceleration, and $P_s$ is a pressure loss of the second liquid channel with a maximum liquid flow rate when the liquid container is used.

19. The liquid container according to claim 11, wherein the liquid is liquid containing a pigment.

* * * * *